United States Patent [19]

Busch et al.

[11] 4,078,419

[45] Mar. 14, 1978

[54] METHOD AND APPARATUS FOR TESTING THE ACCURACY OF AN ELECTRONIC CLOCK

[75] Inventors: Dieter Busch, Rosbach; Manfred Stein, Eschborn, both of Germany

[73] Assignee: VDO Adolf Schindling AG, Frankfurt am Main, Germany

[21] Appl. No.: 747,731

[22] Filed: Dec. 6, 1976

[30] Foreign Application Priority Data

Dec. 13, 1975 Germany ..... 2556181

[51] Int. Cl.[2] ..... G04B 17/00

[52] U.S. Cl. ..... 73/6

[58] Field of Search ..... 73/6; 58/35 W, 24–26

[56] References Cited

U.S. PATENT DOCUMENTS 3,946,592 3/1976 Ichikawa et al. ..... 73/6

*Primary Examiner*—Donald O. Woodiel

*Attorney, Agent, or Firm*—Otto John Munz

[57] ABSTRACT

An electronic clock, such as a quartz-crystal clock, is tested and may be adjusted by measuring the oscillation frequency of the clock with an active antenna. The oscillation frequency is electrically compared with a reference frequency to determine deviation and provide an output indication. Internal calibration is carried out when the system is not being used for testing.

15 Claims, 1 Drawing Figure

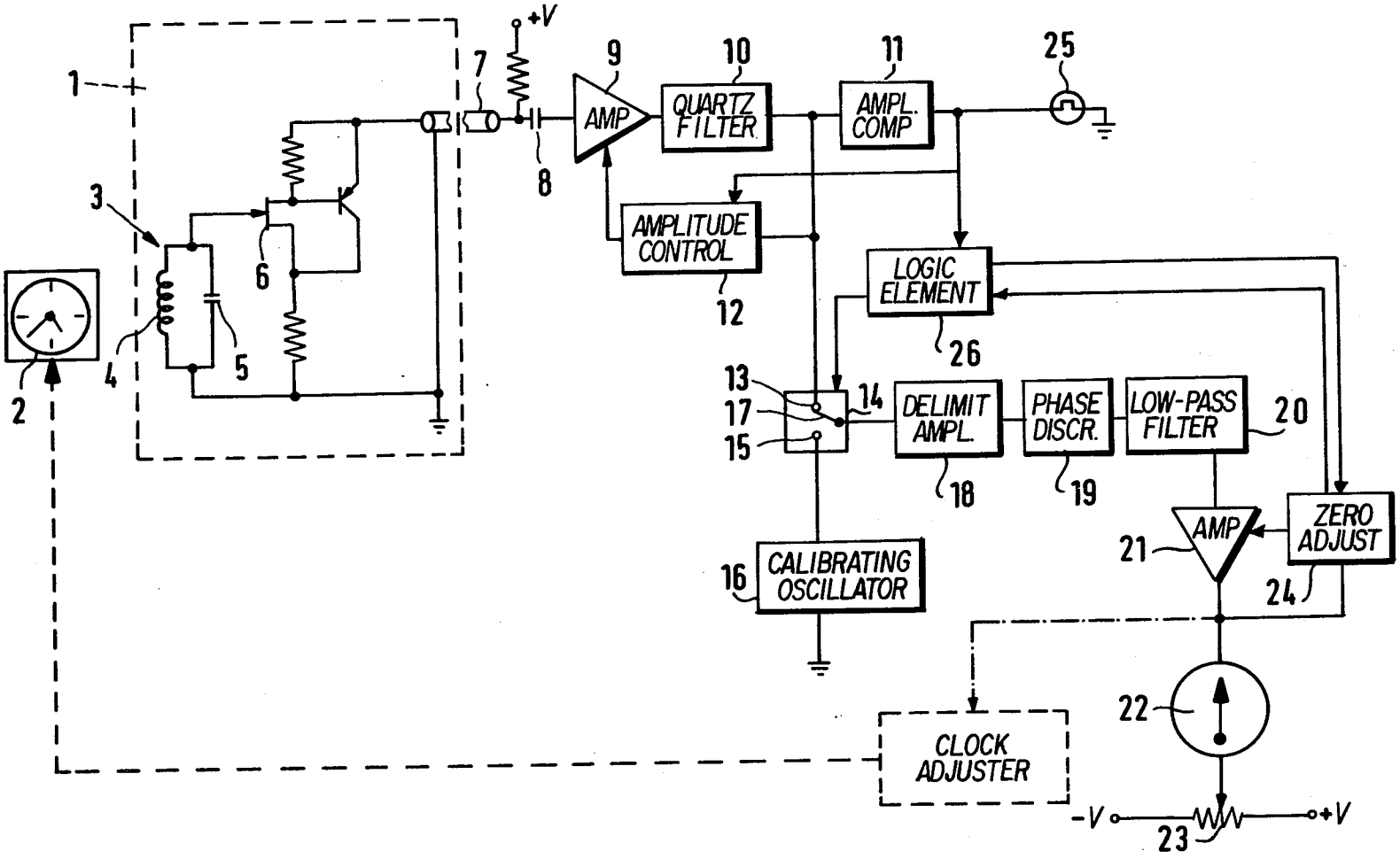
ZERO ADJUST
24
20
LOW-PASS FILTER
AMP
21
22
+V
23
-V
PHASE DISCR.
19
DELIMIT AMPL.
18
CLOCK ADJUSTER
CALIBRATING OSCILLATOR
16
14
13
17
15
LOGIC ELEMENT
26
25
AMPL. COMP
11
QUARTZ FILTER
10
AMPLITUDE CONTROL
12
AMP
9
+V
8
7
6
5
4
3
1
2

METHOD AND APPARATUS FOR TESTING THE ACCURACY OF AN ELECTRONIC CLOCK

BACKGROUND OF THE INVENTION

1. FIELD OF THE INVENTION

The invention relates to a method and apparatus for testing the accuracy of an electronic clock, particularly a quartz crystal clock with an oscillator, including means for triggering electronic indicating devices to compare the oscillations generated by the clock with a reference oscillation.

CROSSREFERENCE TO PRIOR APPLICATION

Priority of German application No. P 25 56 181.3 filed Dec. 13, 1975 is claimed under the Convention.

DESCRIPTION OF THE PRIOR ART

Methods and devices for testing the accuracy of an electronic clock are known in which the noise created by the clock's balance is picked up by a microphone and is translated into an electrical signal. This frequency signal, together with a reference frequency signal, controls a recording stylus of a strip chart in such a manner that the recording stylus is moved along the strip chart in a wave pattern in accordance with the reference frequency in a motion transverse to the directional motion of the strip chart. The frequency of the output signal of the microphone causes the stylus to be lowered or raised in turn. If the frequency of the balance noise equals the reference frequency, a line parallel to the directional flow of the strip chart will result. If the two frequencies are not equal, the charted line will be at an angle to the direction in which the strip chart moves. Such devices and methods are suitable only for electric clocks with a common balance frequency, because the time needed for the testing and the calibrating of a clock whose motor is triggered by a lower frequency is between one or two minutes for the most commonly used frequencies, and therefore such devices and methods are not practicable. Such a time-consuming method could not be used in the mass production of clocks. Such a method has the added disadvantage that the testing and indicating precision is not highly accurate.

SUMMARY OF THE INVENTION

The present invention provides a method which permits the clock to be tested for accuracy and which makes necessary corrective adjustments in the shortest possible time and with the required precision. Use of this method is also possible with minimal capital investments. In the invention, an antenna meters the oscillatory frequency of the oscillator of the clock and, by a comparison of this frequency with a reference frequency, the deviation is measured electronically. The method of the invention provides a test for accuracy, especially of quartz crystal clocks, which can be made quickly and with the required precision. This method can be implemented with minimal capital investments when compared with the speed with which the clock can be tested and calibrated.

The testing accuracy can be further increased to great advantage by repeatedly comparing the oscillatory frequency of the oscillator with the reference frequency, a calibration being made after each comparison. Because the comparison of the two frequencies and the calibration of the reference frequency are done electronically, the actual testing time is increased only minimally by such repeated comparison. The invention further relates to a circuit arrangement to perform the tasks required by the method of the invention. The circuit arrangement differs from known arrangements in that it provides an antenna for measuring the oscillator frequency, means for providing a reference frequency, means for comparing the antenna output signal with the reference frequency, and means for indicating a deviation of the frequency of the antenna output signal from the reference frequency signal according to extent and phase. Using a circuit arrangement of this kind, the clock can be tested for accuracy and calibrated in less than a second. This very rapidly executed test, which may be repeated, permits the indication of any deviation by means of a simple analog indicating instrument, and additional registration means, such as paper, ink, etc., are superfluous. Thus, the circuit arrangement of this invention is always ready for use and no preparation time is needed, as in the known devices, for insertion of paper and filling of ink containers. The speed of testing with apparatus according to the invention becomes particularly important when the circuit arrangement of this invention is to be used in mass production. The circuit arrangement of the invention is particularly suitable for use as a fully automatic test-unit and calibrating unit because it can perform the accuracy test in less than a second.

In a preferred embodiment of the invention, an active antenna is provided consisting of an oscillating circuit with a ferrite core coil and a field-effect transistor with a shielded cable connected to its drain-source path. Such an antenna, which is provided with an operating voltage by way of a shielded cable, has an advantage over other, equally usable antennas, in that it has a relatively narrow band but is highly sensitive in this narrow-band area. Thus, this circuit arrangement will not react to interfering fields or will only do so under the most unfavorable conditions. For this reasons, it is recommended that the antenna be followed by a quartz filter which has a particularly narrow band.

According to a further feature of the invention, a discriminator with at least one crystal is provided as a means for furnishing a reference frequency and for comparison of the reference frequency signal with the antenna output signal. However, in this embodiment a reference signal proper is not produced. The input of the discriminator has a clipper circuit and its output has a low-pass filter. It is preferable to choose the mean frequency of the discriminator to be equal to the nominal oscillatory frequency of the clock. This improves the linear test indication. The use of the discriminator also has the advantage that at its output there is a d.c. voltage available, which may be used directly in an indicating instrument and/or for driving a calibrating device.

It is preferable to provide a phase discriminator. An amplitude discriminator could well be used, but it is more expensive than a phase discriminator and its construction is less advantageous.

Since fluctuations of the amplitude of the antenna output signal below the value given by the clipper circuit could lead to erroneous data, it is advisable to provide an amplitude comparator which disconnects at least the means for comparison of the antenna output signal with the reference frequency signal from the antenna output signal whenever the antenna output signal falls below a certain amplitude. It is useful to follow the antenna with an amplifier with an amplitude control. Thereby, the testing accuracy of the means to compare the antenna output signal with the reference frequency signal can be further increased. In a preferred embodiment, the amplitude control device can be switched to be operative or inoperative in such a way that, should the output signal rise above a predetermined amplitude, the amplitude control is switched on, and stays switched on until the output signal again drops below the predetermined amplitude level.

According to a further feature of the invention, the means for indicating a frequency deviation is connected in series with a controllable amplifier. A change-over switch is provided which, in a first position, switches the antenna output signal and in a second position the output signal of a calibrating oscillator through the means which provide a reference frequency and compares the antenna output signal with the reference frequency signal. Such a step permits calibration of the circuitry to correspond to the nominal frequency by the corresponding control of the amplifier between two tests. In this manner, metering errors which may be caused by, for instance, a detuning of the discriminator circuit caused by temperature fluctuations, can be avoided with great certainty. In this invention, the process of calibration can be simplified still further, when the second position of the change-over switch is provided with a further step, effectively connected for the control of the controllable amplifier.

In an embodiment of the invention, the change-over switch can be triggered by a clock generator so that it is activated at periodic intervals. It is, however, more advantageous to trigger the change-over switch in such a manner that it is in its first position when the clock is tested, and in its second position whenever the clock is removed from the antenna. In this manner the calibration of the reference frequency signal takes place during the time intervals when the circuit is not being used for metering of the clock accuracy. This procedure serves to minimize the time required for the accuracy test of the clock. The last mentioned method of driving the change-over switch may be effectively realized by having this switch triggered by the amplitude comparator.

The indication of a frequency deviation may be either digital or analog. Economy suggests the use of an electromagnetic instrument having a zero-mark in the center of its dial to indicate such deviations. In adjustment procedures, such an instrument permits much easier recognition of certain trends than a digital indicator.

BRIEF DESCRIPTION OF THE DRAWINGS

The invention is described more closely, using the drawing, which shows a block diagram of the circuit arrangement.

DESCRIPTION OF THE PREFERRED EMBODIMENT

The circuit arrangement consists of an active antenna 1 which receives the oscillations of the quartz-crystal clock 2. The active antenna 1 consists of an oscillating or resonant tank circuit 3 with a ferrite core coil 4 and a capacitor 5, as well as a field-effect transistor 6. The oscillating circuit 3 is connected by way of the field-effect transistor to a shielded cable 7. The active antenna 1 receives its operating voltage by way of cable 7. The end of cable 7 opposite the antenna is connected by way of a capacitor 8 to the input of a controllable amplifier 9. A quartz filter 10 is connected to the output of amplifier 9 and an amplitude comparator 11 is connected to the filter output. The output of the amplifier is further connected via filter 10 to an amplitude controlling means 12 and to one contact 13 of a change-over switch 14. The other contact 15 of the change-over switch 14 is connected to a calibrating oscillator 16. A phase discriminator 19 with a crystal is connected by way of a delimiter amplifier 18 to a central contact 17 of the change-over switch 14. The mean frequency of discriminator 19 is equal to the nominal frequency of the oscillator (not illustrated) in clock 2. In order to eliminate the higher frequencies in the discriminator output signal, a low-pass filter 20 is provided which is connected with an indicating instrument 22 by way of a controllable amplifier 21. For a rough adjustment of the zero-position of the indicating instrument 22, a controllable resistor 23 is provided, by adjustment of which the indicating instrument 22 is set at zero-potential or negative potential respectively. Control of amplifier 21 is effected by a zero-adjuster 24. When a clock 2 is placed in close proximity to the antenna 1, a powerful output signal is provided by amplifier 9, so that the predetermined amplitude threshold of the amplitude comparator 11 is surpassed. The amplitude comparator 11 puts the amplitude controlling means 12 into effect, switches the zero-adjuster 24 to be inoperative, and switches the contact 17 of the change-over switch 14 into the illustrated position. Simultaneously, an indicator lamp 25 lights up, signalling that an accuracy test is being performed. The triggering of amplifier 9 by the amplitude controlling means 12 and the screening of the amplifier output signal by the quartz filter 10 provide a signal with a highly constant amplitude. After further effect upon the signal by the delimiter amplifier 18, the signal reaches the phase discriminator 19. Depending upon the momentary oscillatory frequency of the oscillator in the clock 2, a certain potential appears at the output of the phase discriminator 19, which becomes zero when the oscillatory frequency of the oscillator in the clock 2 and the resonance frequency of the crystal in the phase discriminator 19 are equal. The signal appearing at the output of the phase discriminator 19 is stripped of its high frequencies by the low-pass filter and the resulting positive or negative d.c. signal is passed on through the amplifier 21 (which could also be designed as an operational amplifier) to the indicating instrument 22. As soon as clock 2 is removed, the input signal at amplifier 9 and thereby at the amplitude comparator 11 sinks to a level below the threshold value of the amplitude comparator 11. This causes the amplitude controlling means to become inoperative, the zero adjuster to become operative, and the contact 17 of the change-over switch 14 to be switched to contact 15. Lamp 25 goes out, signalling that calibration is in process. In this process of calibration, a calibrating oscillator 16, sends a signal equal to the nominal oscillatory frequency of the clock 2 through the delimiter amplifier 18 to the phase discriminator 19. The d.c. signal appearing at the output of the low-pass filter 20 corresponds to an accuracy of 100%, and after amplification should not cause any needle deflection of the indicating instrument. If the output signal from amplifier 21 is too great or too small to allow a zero deflection, a corresponding adjustment of the amplifier 21 is caused by the zero adjuster 24, until the desired signal is obtained at the amplifier output. The calibration of the circuitry, therefore, does not take place in a high-frequency range, but in a d.c. circuit, which has the advantage that the calibrating circuit can be set up in a very much simpler and cheaper manner. The calibrating process is terminated whenever a clock is placed in front of the antenna 1, and the input voltage at the amplitude comparator 11 thus again exceeds the comparator's threshold value.

In order to avoid a possible switch-over to the metering mode when a clock is close to the antenna 1 during a calibrating process, which could lead to faulty calibration and therefore to metering errors, a logic element 26 is provided which is driven by the zero-adjuster 24 and the amplitude comparator 11. The logic element, in case of the presence of a clock before the antenna 1, gives a signal to the change-over switch 14 only after an initiated calibrating process has been completed.

According to a further feature of the invention, the controllable amplifier is followed by an adjusting device 27 which calibrates the clock automatically. This device 27, which in its simplest embodiment may be a motor operator-driven screwdriver to adjust the trimmer of the quartz oscillator inside the clock, could be connected to the amplifier 21 in addition to or instead of the indicating instrument.

What is claimed is:

1. A system for testing the accuracy of an electronic clock, comprising

A. antenna means adapted to be placed in the vicinity of a clock for receiving an oscillating signal equal in frequency to a sensed oscillating signal in the clock, B. means for defining a reference frequency, C. comparison means for comparing the frequency of the received oscillating signal with the reference frequency, and D. means responsive to the comparison means for indicating the difference between the frequency of the received oscillating signal and the reference frequency.

wherein the antenna means comprises an active antenna comprising:

E. a resonant tank circuit including a ferrite-core coil for sensing the oscillating signal from the clock, F. a field-effect transistor connected to the tank circuit to pre-amplify the oscillating signal sensed from the clock, and G. a shielded-cable connected to the drain-source path of the field-effect transistor for providing the received oscillating signal for use by the remainder of the system.

2. A system for testing the accuracy of an electronic clock, comprising the steps of:

A. antenna means adapted to be placed in the vicinity of a clock for receiving an oscillating signal equal in frequency to a sensed oscillating signal in the clock, B. means for defining a reference frequency, C. comparison means for comparing the frequency of the received oscillating signal with the reference frequency, and D. means responsive to the comparison means for indicating the difference between the frequency of the received oscillating signal and the reference frequency, further comprising a discriminator including at least one crystal, the crystal providing the means for defining the reference frequency and the discriminator providing the comparison means, the discriminator being responsive to the received oscillating signal from the antenna for providing an output signal representative of the difference between the frequency of the received oscillating signal and the reference frequency of the crystal.

3. A system for testing the accuracy of an electronic clock as claimed in claim 2, wherein the discriminator is a phase discriminator.

4. A system for testing the accuracy of an electronic clock as claimed in claim 3, wherein the means frequency of the discriminator is equal to the nominal oscillator frequency of the clock.

5. A system for testing the accuracy of an electronic clock as claimed in claim 4, further comprising:

a quartz filter responsive to the received signal from the antenna for feeding the received signal to the comparison means.

6. A system for testing the accuracy of an electronic clock as claimed in claim 5, further comprising:

an amplitude comparator for disconnecting at least the comparison means from an antenna output signal whenever the antenna output signal falls below a predetermined amplitude.

7. A system for testing the accuracy of an electronic clock as claimed in claim 6, wherein the antenna feeds an amplifier with amplitude-control means.

8. A system for testing the accuracy of an electronic clock as claimed in claim 7, wherein the amplitude-control means is made operative or inoperative by the amplitude comparator.

9. A system for testing the accuracy of an electronic clock, comprising:

A. antenna means adapted to be placed in the vicinity of a clock for receiving an oscillating signal equal in frequency to a sensed oscillating signal in the clock, B. means for defining a reference frequency, C. comparison means for comparing the frequency of the received oscillating signal with the reference frequency, and D. means responsive to the comparison means for indicating the difference between the frequency of the received oscillating signal and the reference frequency, to connect in series the indicating means with a controllable amplifier, and further comprising:

a change-over switch, which, in a first position, switches an antenna output signal, and in a second position, an output signal of a calibrating oscillator through the comparison means, for comparing the antenna output signal with the reference signal.

10. A system for testing the accuracy of an electronic clock as claimed in claim 9, wherein in the second position of the change-over switch, a zero adjuster for control of the controllable amplifier is operative.

11. A system for testing the accuracy of an electronic clock as claimed in claim 10, wherein the change-over switch is driven by a clock generator.

12. A system for testing the accuracy of an electronic clock as claimed in claim 10, wherein the change-over switch is arranged such that it is in its first position during the testing of the clock and in its second position whenever the clock is removed from the vicinity of the antenna.

13. A system for testing the accuracy of an electronic clock as claimed in claim 12, wherein the change-over switch is driven by the amplitude comparator.

14. A system for testing the accuracy of an electronic clock as claimed in claim 13, wherein the controllable amplifier is followed by a calibration adjusting device for automatic calibration of the clock.

15. A system for testing the accuracy of an electronic clock as claimed in claim 9 wherein the indicating means comprises an electro-magnetic meter with a zero-mark centered on its dial.

* * * * *